US005430527A

United States Patent [19]

Maruyama et al.

[11] Patent Number: 5,430,527

[45] Date of Patent: Jul. 4, 1995

[54] ELECTROPHOTOGRAPHIC APPARATUS HAVING CLEANING WIDTH LARGER THAN CHARGING WIDTH

[75] Inventors: Akio Maruyama; Junichi Kishi; Hiroyuki Ohmori; Masami Okunuki, all of Tokyo, Japan

[73] Assignee: Canon Kabushiki Kaisha, Tokyo, Japan

[21] Appl. No.: 263,394

[22] Filed: Jun. 21, 1994

Related U.S. Application Data

[63] Continuation of Ser. No. 137,220, Oct. 18, 1993, abandoned, which is a continuation of Ser. No. 839,716, Feb. 24, 1992, abandoned, which is a continuation of Ser. No. 555,359, Jul. 18, 1990, abandoned, which is a continuation of Ser. No. 212,655, Jun. 28, 1988, abandoned.

[30] Foreign Application Priority Data

Jun. 30, 1987 [JP] Japan ..... 62-163560
Aug. 14, 1987 [JP] Japan ..... 62-201835

[51] Int. Cl.[6] ..... G03G 5/00
[52] U.S. Cl. ..... 355/219; 355/296
[58] Field of Search ..... 355/211, 219, 221, 277, 355/296, 299, 300, 301; 361/225; 250/324, 325

[56] References Cited

U.S. PATENT DOCUMENTS

| | | | |
|---|---|---|---|
| 2,892,973 | 6/1959 | Straughan | 361/225 |
| 4,278,342 | 7/1981 | Andrew et al. | 250/325 X |
| 4,547,060 | 10/1985 | Lindblad | 355/219 |
| 4,654,288 | 3/1987 | Hiro et al. | 430/126 |
| 4,727,453 | 2/1988 | Ewing | 361/225 |

FOREIGN PATENT DOCUMENTS

| | | |
|---|---|---|
| 0083068 | 5/1985 | Japan . |
| 0246781 | 11/1986 | Japan . |

*Primary Examiner*—Robert B. Beatty
*Attorney, Agent, or Firm*—Fitzpatrick, Cella, Harper & Scinto

[57] ABSTRACT

An image forming apparatus has a photosensitive member, a charging device, an image exposure device for exposing the photosensitive member to form a latent image, a developing device for developing the latent image with a toner to form a transferable toner image on the surface of the photosensitive member, a transfer device for transferring the toner image to a transfer material, and a cleaning device for removing a residual toner; the charging device, image exposure device, developing device, transfer device and cleaning device being disposed in the named order along the moving direction of the photosensitive member. The charging device includes an electroconductive member which directly contacts the photosensitive member surface to charge the photosensitive member surface. The electroconductive member forms a nip width with the photosensitive member of at least 0.5 mm and a load per unit contact area between the electroconductive member and photosensitive member is between 0.5–30 g/mm$^2$. With respect to the longitudinal direction of the photosensitive member, the width of the photosensitive member surface cleaned by the cleaning device is equal to or greater than the width of the photosensitive member surface contacting the electroconductive member.

5 Claims, 2 Drawing Sheets

ELECTROPHOTOGRAPHIC APPARATUS HAVING CLEANING WIDTH LARGER THAN CHARGING WIDTH

This application is a continuation of prior application Ser. No. 08/137,220, filed on Oct. 18, 1993, which is a continuation of Ser. No. 07/839,716, filed on Feb. 24, 1992, which is a continuation of Ser. No. 07/555,359, filed on Jul. 18, 1990, which is a continuation of Ser. No. 07/212,655, filed on Jun. 28, 1988, all now abandoned.

FIELD OF THE INVENTION AND RELATED ART

The present invention relates to an electrophotographic apparatus such as a copying machine, more particularly to an electrophotographic apparatus including a charging means which is capable of causing an electroconductive member to contact the surface of a photosensitive member and directly apply a voltage thereto to charge the photosensitive member surface.

In a conventional electrophotographic apparatus, there have been used photosensitive members utilizing an organic photoconductive material (hereinafter, referred to as "OPC") which are low in cost and can easily be produced, in addition to those utilizing an inorganic photoconductive material such as CdS-resin dispersion-type, ZnO-resin dispersion-type, Se or Se—Te vapor deposition-type, and amorphous-silicon-type. These photosensitive members are subjected to a fundamental electrophotographic process including charging, exposure, developing, transfer and fixing, and cleaning steps, whereby a copied image is provided.

In the above-mentioned conventional charging step, in most cases, a high voltage (DC voltage of about 5–8 KV) is applied to a metal wire to generate a corona, which is used for the charging. In this method, however, a large amount of corona discharge products such as ozone, $NO_x$ is generated along with the generation of the corona. Such corona discharge products deteriorate the photosensitive member surface to cause image quality deterioration such as image blur (or image fading). Further, because the contamination on the metal wire immediately affects the image quality, there has been a problem that white defects or black streaks occur in the resultant copied image. Moreover, the proportion of the current directed to the photosensitive member is generally 5–30% of the consumed current, and most thereof flows to a shield plate disposed around the metal wire. As a result, the conventional corona charging method has been low in electric power efficiency.

Therefore, in addition to the above-mentioned corona charging method, there has been researched a direct charging method (or contact charging method) wherein an electroconductive member is caused to directly contact a photosensitive member to charge the photosensitive member, as disclosed in U.S. Pat. Nos. 3,146,385, 4,259,003; and Japanese Laid-Open Patent Application (JP-A, KOKAI) Nos. 178267/1982, 104351/1981, 40566/1983, 139156/1983, 150975/1983, etc. More specifically, in this method, a charging member such as an electroconductive roller, to which a DC voltage of about 1–2 KV is externally applied, is caused to contact the surface of a photosensitive member and charges are directly injected to the photosensitive member surface thereby to charge the photosensitive member surface up to a predetermined potential.

The direct charging method is advantageous to a photosensitive member because it provides high charging efficiency and very little corona discharge product. Further, the direct charging method is particularly advantageous to an OPC photosensitive member. The reason for this is that the OPC photosensitive member has a disadvantage that it is liable to deteriorate due to the corona discharge product as compared with another type of photosensitive member, while it can provide a wide range of choice with respect to spectral sensitivity and can be produced at low cost.

More specifically, the OPC photosensitive member used at present has a lower chemical stability than that of the amorphous silicon-type or Se-type photosensitive member, and is liable to cause a chemical reaction (mainly, an oxidation reaction) to be deteriorated when subjected to the corona discharge product. Therefore, when the OPC photosensitive member is repeatedly used under the action of corona discharge, there occur image blur due to the above-mentioned deterioration, decrease in copied image density due to the decrease in the photosensitive member sensitivity, etc. As a result, the life of the OPC photosensitive member in successive copying operations is shortened.

Accordingly, in a case where the OPC photosensitive member is used, it is extremely advantageous to charge the photosensitive member by the above-mentioned direct charging method which provides a high charging efficiency and only a very small amount of the corona discharge product, in order to suppress the occurrence of an image defect such as image blur and to lengthen the life of the photosensitive member in successive copying operations.

However, in spite of the above-mentioned many proposals, an electrophotographic apparatus utilizing the direct charging method has never been put on the market up to the present. The reason for this is, e.g., that the conventional direct charging method cannot charge a photosensitive member uniformly but causes a dielectric breakdown of the photosensitive member due to the direct application of a voltage. The nonuniformity in the direct charging occurs because a charging member does not contact the photosensitive member well, and the nonuniformity provides uneven charges on the photosensitive member whereby output images with uneven image density corresponding to the above uneven charges are provided.

The nonuniformity in the direct charging may be solved to a certain extent by causing an elastic electroconductive member to uniformly contact a photosensitive member in a nip width of above a certain value and under a certain load. Particularly, in combination with an OPC photosensitive member, the uniformity in the direct charging may be obtained relatively easily even when the load is not too great, because the OPC photosensitive member per se generally has a certain elasticity. In this case, however, when the load is too great, the breakage of the photosensitive member occurs due to relatively small surface hardness thereof.

On the other hand, the dielectric breakdown in the direct charging is caused by scratches on the surface of a photosensitive member. More specifically, charges are partially concentrated on these scratches to cause dielectric breakdown. In a pin hole portion generated by the dielectric breakdown, a leak of current occurs, whereby there occurs a phenomenon that the voltage to be applied to the photosensitive member falls considerably.

When such phenomenon occurs, a portion of they photosensitive member surface contacting the electroconductive member is not provided with sufficient charge. Therefore, in the case of a normal development system, such phenomenon appears as a white defect extending along the longitudinal direction of the contact portion between the electroconductive member and the photosensitive member. On the other hand, in the case of a reversal development system, such phenomenon appears as a black streak extending along the longitudinal direction of the contact portion. Particularly, because an OPC photosensitive member has a smaller surface hardness than other photosensitive members, the surface thereof is liable to be scratched thereby causing a dielectric breakdown. Accordingly, the current leak in the direct charging method caused by the scratch has considerably hindered the commercial introduction of the direct charging method.

Incidentally, with respect to the surface of a photosensitive member, a charging width generally includes an imaging width, and further is larger than the imaging width, in order to enhance the uniformity in the resultant image. Herein, "charging width" refers to the width of a portion of the photosensitive member surface subjected to a charging operation. Further, "imaging width" refers to the width of a portion of the photosensitive member surface which actually contributes to image formation. Both the charging width and the imaging width are measured in the longitudinal direction perpendicular to the moving direction of the photosensitive member.

Heretofore, because the portion of a photosensitive member on which developer (or toner) particles are attached is not larger than the maximum imaging width, the width of a portion of the photosensitive member surface subjected to a cleaning operation (hereinafter, referred to as "cleaning width") has been smaller than the charging width.

In the conventional electrophotographic apparatus, the relationship among the charging width, the cleaning width and the imaging width has not necessarily been clear, but there has generally been a relationship of (charging width)>(cleaning width)>(imaging width). Even in such a case, in an electrophotographic apparatus using the corona charging method, there has been no problem. Such relationship has been rather advantageous to the corona charging method, because the corona generated by both end portions of a corona charger is relatively nonuniform as compared with that generated by the central portion thereof.

However, in a case where the above-mentioned direct charging method is used in the conventional electrophotographic apparatus, only an image with image defect has been provided.

SUMMARY OF THE INVENTION

An object of the present invention is to provide an electrophotographic apparatus which is free from image defects such as image blur, image density decrease in a solid black image, and free from the dielectric breakdown based on direct charging.

Another object of the present invention is to provide an electrophotographic apparatus capable of stably providing high-quality copied images for a long period.

A further object of the present invention is to provide an electrophotographic apparatus using an OPC photosensitive member, which is capable of suppressing the occurrence of image defects due to the deterioration thereof and realizing a long life of the photosensitive member in successive copying operations.

As a result of our study on the above problems, it has been found that attachments which have been attached to a portion of a photosensitive member surface outside the maximum imaging width even in a very small amount, considerably affect the charge uniformity obtained by a direct charging method.

The electrophotographic apparatus of the present invention is based on the above discovery and comprises: a photosensitive member, charging means, image exposure means for exposing the photosensitive member to form a latent image, developing means for developing the latent image with a toner to form a transferable toner image on the surface of the photosensitive member, transfer means for transferring the toner image to a transfer material, and cleaning means for removing a residual toner; the charging means, image exposure means, developing means, transfer means and cleaning means being disposed in this order along the moving direction of the photosensitive member; the charging means comprising an electroconductive member which directly contacts the photosensitive member surface to change the photosensitive member surface;

wherein with respect to the longitudinal direction of the photosensitive member, the width of the photosensitive member surface cleaned by the cleaning means is not smaller (i.e. is equal to or larger) than the width of the photosensitive member surface contacting the electroconductive member.

According to our detailed observation, it has been found that attachments such as scattered toner particles, dust, and metal powder, even in a very small amount, are attached to a portion of a photosensitive member surface outside the maximum imaging width thereof.

The mechanism by which the above-mentioned attachments affect the image quality, is not yet clear but may be considered as follows according to our knowledge.

In an electrophotographic apparatus wherein the relationship of (charging width)>(cleaning width)>(imaging width) is set, the above-mentioned attachments present outside the cleaning width cannot be removed in a cleaning step, and then the photosensitive member surface on which the attachments remain as such contacts an electroconductive member for the direct charging, whereby the attachments scratch and damage the photosensitive member surface. As a result, such scratches function as nuclei to cause a dielectric breakdown.

The pin hole produced by such dielectric breakdown is present in a portion outside the imaging width. However, in the direct charging method, a voltage is directly applied to the photosensitive member by causing it to contact an electroconductive member unlike the conventional corona charging method. Therefore, if only one pin hole is present within the charging width, even outside the imaging width, currents converge on the pin hole as a leakage current. As a result, such phenomenon provides uneven charges on the photosensitive member, even in the imaging width, to cause unevenness in the resultant copied image, as described above.

On the contrary, in the present invention, because the cleaning width is not smaller than the charging width, the above-mentioned attachments which are present outside the imaging width are sufficiently removed by a cleaning means whereby the dielectric breakdown is desirably prevented.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the electrophotographic apparatus according to the present invention, an electroconductive member as a charging means is so disposed as to contact a photosensitive member, and a cleaning means is so disposed that the cleaning width (i.e., the width, in the longitudinal direction of the photosensitive member, of a region of the photosensitive member surface subjected to the cleaning operation conducted by the cleaning means) at least includes the charging width (i.e., the width, in the longitudinal direction of the photosensitive member, of a region of the photosensitive member surface contacting the electroconductive member). The "longitudinal direction" used herein refers to the direction perpendicular to the moving direction of the photosensitive member.

In the present invention, because of the above-mentioned arrangement, there is prevented the dielectric breakdown which can be caused by attachments, such as toner particles remaining on the photosensitive member surface without being removed by a cleaning means, whereby there is obtained an electrophotographic apparatus which has a good charging characteristic, and is capable of providing high-quality images and may be used for a long period.

Hereinbelow, an embodiment of the electrophotographic apparatus according to the present invention will be described with reference to FIG. 1, which is a schematic partial view showing an essential part of an embodiment of the electrophotographic apparatus.

Figure 1:
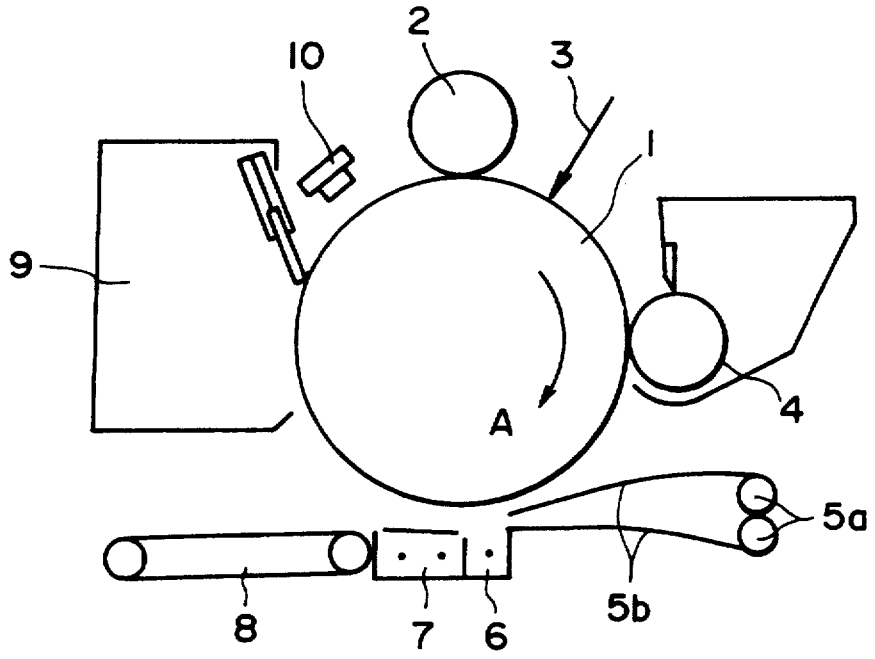
FIG. 1 is a schematic view of an essential part of an embodiment of the electrophotographic apparatus of the present invention.

Referring to FIG. 1, the electrophotographic apparatus comprises: a cylindrical photosensitive member 1, and around the photosensitive member 1, an electroconductive roller (or charging roller) 2 as an electroconductive member for directly charging the photosensitive member 1, an image exposure unit (not shown) for providing a light beam 3 to form a latent image on the photosensitive member 1, a developing apparatus 4 for developing the latent image with a toner to form a toner image, a feeder comprising a pair of feed rollers 5a and a guide 5b for supplying a transfer material such as paper (not shown), a transfer charger 6 for transferring the toner image from the photosensitive member 1 onto the transfer material, a separation charger 7 for separating the transfer material from the photosensitive member 1, a conveyor 8 for conveying the separated transfer material to a fixing apparatus (not shown) a cleaner 9 for removing residual toner, and a light source 10 for pre-exposure.

In operation, the photosensitive member 1 is rotated in the direction of an arrow A at a predetermined peripheral speed, and an image formation is effected according to a known electrophotographic image formation process.

Figure 2:
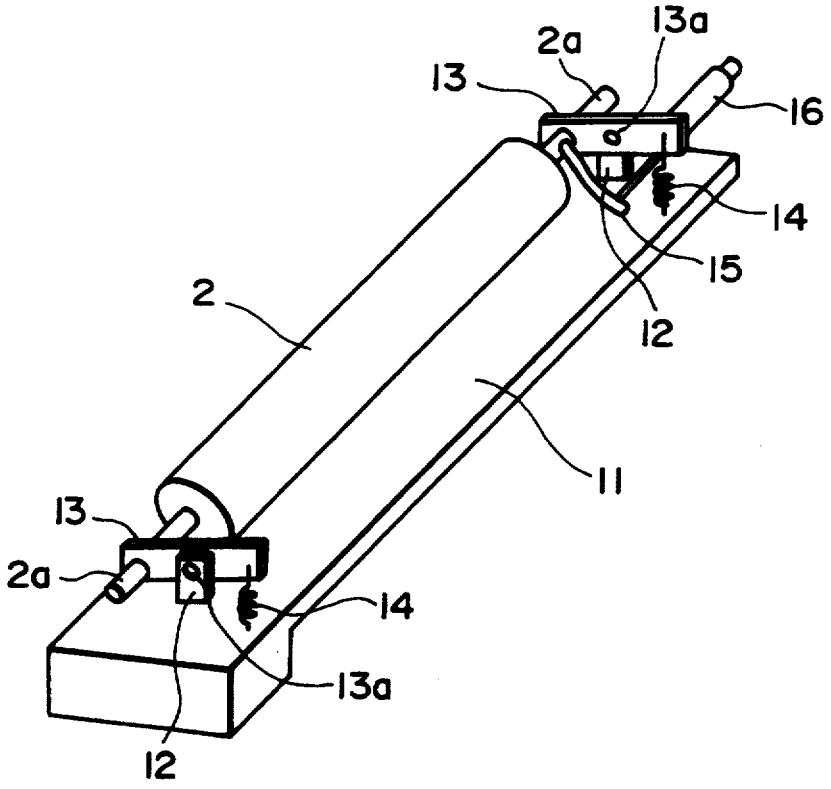
FIG. 2 is a schematic perspective view showing a support unit for an electroconductive member.

FIG. 2 is a schematic perspective view showing a support unit for the electroconductive roller 2 as an electroconductive member. Referring to FIG. 2, the electroconductive roller 2 is supported by a support plate 11, and at both ends thereof, a roller-supporting arm 13 is disposed, so that roller 2 can be rocked or swung around an axis 13a of upright support member 12 which is affixed to support plate 11. At one end of the roller-supporting arm 13, the electroconductive roller 2 is rotatably disposed by the medium of a metal core bar 2a. Between the other end of the supporting arm 13 and the support plate 11, a spring 14 for pressing the roller 2 onto the photosensitive member 1 is disposed under tension.

In the electrophotographic apparatus of the present invention, the support plate 11 is disposed, e.g., by means of a guide rail (not shown), on the side of the apparatus body, so that the electroconductive roller 2 contacts the photosensitive member 1 under the action of a spring 14 under a predetermined contact pressure and in a predetermined nip width. Further, in FIG. 2, reference numeral 15 denotes a feed brush for supplying a voltage to the electroconductive roller 2 by the medium of the metal core bar 2a, and numeral 16 denotes a receiving connector for receiving a voltage from the apparatus-body.

Incidentally, as described above, there have been submitted many proposals with respect to the direct charging method for electrophotographic apparatus wherein an electroconductive member is caused to contact the surface of a photosensitive member, and a voltage is applied to the electroconductive member to charge the photosensitive member surface. In the present invention, such various conventional methods can be used without particular restriction, in addition to that used in the above-described specific embodiment.

Further, the form or shape of the electroconductive member may be, in addition to the above-mentioned roller form, any of brush (inclusive of magnetic brush), blade, belt, etc. The form of the electroconductive member can appropriately be selected corresponding to the specifications and form of an electrophotographic apparatus. The material constituting the electroconductive member includes: metals such as aluminum, iron and copper; electroconductive polymer materials such as polyacetylene, polypyrrole and polythiophene; rubbers or artificial fibers supplied with electroconductivity, e.g., by dispersing carbon or metal therein; and insulating material such as polycarbonate, polyvinyl chloride and polyethylene having a surface coated with metal or another conductive material. The resistivity of the electroconductive member contacting the photosensitive member 1 may preferably be $10^0$–$10^{12}$ Ω.cm, particularly $10^2$–$10^{10}$ Ω.cm, in view of good charging characteristics and prevention of a dielectric breakdown. The hardness of the electroconductive member may preferably be 50 degrees or less, in terms of the rubber hardness according to JIS-A Standard.

The arrangement of the electroconductive member 2 relative to the photosensitive member 1 should not particularly be restricted. More specifically, such arrangement may include: one wherein the electroconductive member 2 is fixed; one wherein the electroconductive member is rotated while following the movement of the photosensitive member; or one wherein the electroconductive member is independently rotated in the same direction as or the opposite direction to that of the movement of the photosensitive member. Further, the electroconductive member 2 can also be caused to have a cleaning function of removing the residual toner particles attached to the photosensitive member 1.

The voltage applied to the electroconductive member 2 may be any of DC voltage, AC voltage, or a superposed voltage obtained by superposing an AC voltage on a DC voltage. Further, the application method therefor, while varying depending on the specifications of respective electrophotographic apparatus, may include: one wherein a desired voltage is instantaneously applied; one wherein the applied voltage is gradually raised, e.g., in order to protect the photosensitive member; or one wherein a DC voltage and an AC voltage are applied in a sequence of from DC voltage to AC voltage, or of from AC voltage to DC voltage.

The nip width between the electroconductive member 2 and the photosensitive member 1 is substantially determined by the relationship between the elasticity of the electroconductive member 2 and the total load applied thereto. In the present invention, the nip width may preferably be 0.5 mm or more in order to retain an appropriate contact pressure and to effect uniform charging.

In order to apply a load to the interface (or contact face) between the photosensitive member 1 and the electroconductive member 2, there may be used a plate spring, a rubber member, etc., in addition to the coil spring 14 of metal, etc., as shown in FIG. 2. Further, the load can be applied by utilizing the weight of the electroconductive member 2 per se. The load per unit area may preferably be 0.5–30 g/mm$^2$, particularly 1–20 g/mm$^2$. The load per unit area may be calculated according to the following formula:

$$\text{load per unit area} = \frac{\text{total load (g)}}{S},$$

wherein S (contact area)=(contact width)×(contact length), and wherein the contact width (or nip width) and the contact length are those between the electroconductive member 2 and the photosensitive member 1.

The cleaning method used in the present invention is not particularly restricted and may be any of known cleaning methods such as the blade cleaning method, the brush cleaning method and the roller cleaning method. The cleaning method may be selected corresponding to the kind of electrophotographic apparatus, or the specifications or form thereof.

Figure 3:
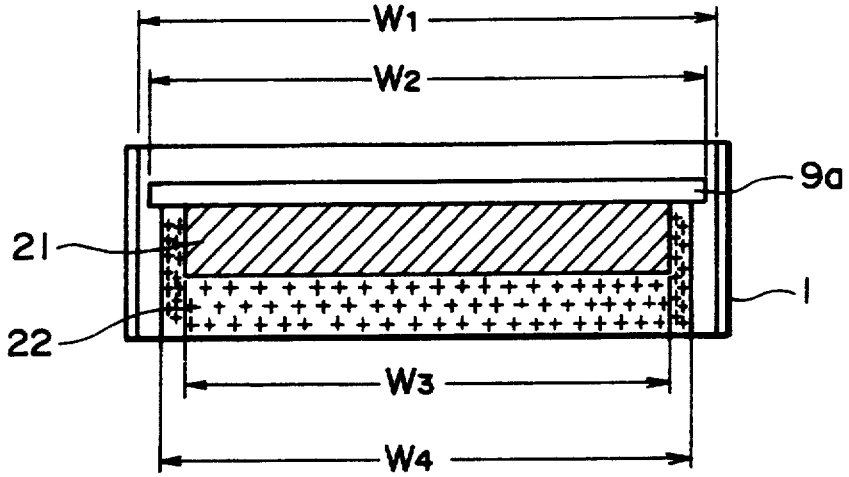
FIG. 3 is a schematic plan view showing a positional relationship between a charging width and a cleaning width on a photosensitive member surface, as seen from above a cleaning means.

In the present invention, as shown in FIG. 3, it is important that the cleaning width ($W_2$) a cleaning region subjected to a cleaning operation (e.g., that equal to the width of a cleaning means 9*a*) is not less than, preferably larger than, the charging width ($W_4$) of a charging region 22 subjected to the direct charging. In FIG. 3, a symbol $W_1$ denotes the width of a photosensitive member 1, and a symbol $W_3$ denotes the width of an imaging region 21 which actually contributes to image formation. In the present invention, the distances from both ends of the charging width ($W_4$) to the corresponding ends of the cleaning means 9*a*, respectively, may preferably be 0.5 mm or larger, particularly 1 mm or more.

In order to more effectively prevent the photosensitive member surface from being scrached. the photosensitive member surface may preferably have a certain surface hardness. More specifically, the photosensitive member surface may preferably have a scratch hardness of 15 g or more. The scratch hardness used herein is defined as follows:

A normal load is applied to a specimen surface (photosensitive member surface) by means of a cone indenter of diamond or sapphire having a cone angle of 90° and a tip of a 0.01 mm-dia. hemisphere form, and the cone indenter is moved along the specimen surface at a velocity of 50 mm/min. In this case, the load required for providing a scratch with a width of 50 μm is measured and the thus obtained load is defined as the above-mentioned scratch hardness.

In the present invention, the surface hardness of the photosensitive member may be measured in the following manner.

A photosensitive member is fixed, e.g., on the sample stand of a surface characteristic-measuring device Heidon Model-14 (mfd. by Shinto Kagaku K.K.). Then, a normal load is applied to the photosensitive member surface by means of a cone indenter of diamond or sapphire having a cone angle of 90° and a tip with a 0.01 mm-dia. hemisphere form, and the sample stand is moved at a velocity of 50 mm/min, thereby to scratch the photosensitive member surface. The width of the thus obtained scratch may be measured, e.g., by means of a microscope attached to a micro hardness meter MVK-F (mfd. by Akashi Seisakusho K.K. ).

The above-mentioned operation is repeated while changing the normal load at intervals of 5 g, such as 10 g, 15 g, 20 g, 25 g, 30 g, 35 g, 40 g . . . On the basis of the relation of linear regression between the scratch width and the load, the load corresponding to a scratch width of 50 μm is calculated, and defined as the hardness of the photosensitive member. Incidentally, in a case where the photosensitive member has the form of a drum, the photosensitive member is set on the sample stand so that it may be scratched in a direction parallel to the axis of the drum.

The photosensitive layer of the photosensitive member 1 used in the present invention may comprise an inorganic photoconductive material such as amorphous silicon and selenium, or an organic photoconductive material. Among these, a photosensitive member having a photosensitive layer comprising an organic photoconductive material (i.e., an OPC photosensitive member) may be preferred because the photosensitive member per se has an appropriate elasticity and it can easily be supplied with uniform charges in combination with an elastic electroconductive member.

The organic photoconductive material used in the photosensitive layer may appropriately be selected. The examples of the photosensitive layer may include, e.g., those comprising organic photoconductive polymers such as polyvinylcarbazole, and those comprising a low-molecular weight organic photoconductive material and an insulating polymer as a binder. Among these, there may preferably be used a function-separation-type photosensitive member wherein the photosensitive layer has a laminate structure comprising a charge transport layer and a charge generation layer, particularly a photosensitive member comprising an electroconductive substrate, and a charge generation layer and a charge transport layer disposed in this order on the electroconductive substrate.

In order to prepare a photosensitive member used in the present invention, as an electroconductive substrate used therefor, there may be used a cylindrical member, a film, etc., of a material including metals such as aluminum and stainless steel, papers, plastics, etc.

On the electroconductive substrate there may be formed an undercoat layer (or adhesive layer) having a barrier function and an undercoat function. The undercoat layer may be formed as desired, for various purposes. These purposes may include: improvement in the adhesion or coating characteristics of the photosensitive layer, protection of the substrate, covering for the surface defect of the substrate, improvement in charge injection from the substrate, protection of the photosensitive layer from an electric breakdown, etc.

The material of the undercoat layer may be, e.g., polyvinyl alcohol, poly-N-vinylimidazole, polyethylene oxide, ethyl cellulose, methyl cellulose, ethylene-acrylic acid copolymer, casein, polyamide, copolymer nylon, glue, gelatin, etc. These materials may be dissolved in an appropriate solvent and applied onto the substrate. The thickness of the undercoat layer should preferably be about 0.2 to 2 μm.

In the function separation-type photosensitive member, as a charge-generating substance, there may be used, e.g., pyrilium or thiopyrylium dyes, phthalo-cyanine-type pigments, anthanthrone pigments; dibenzyprene-quinone pigment, pyranthrone pigment, trisazo pigments, bisazo pigments, azo pigments, indigo pigments, quinacradone type pigments, quinocyanine compounds, asymmetric quinocyanine compounds, etc. On the other hand, as a charge-transporting substance, there may be used, e.g., hydrazone compounds, pyrazoline compounds, stilbene-type compounds, oxazole compounds, thiazole compounds, triarylmethane compounds, polyaryl alkanes, etc.

In order to form the charge generation layer, e.g., the above-mentioned charge-generating substance and a binder resin preferably in an amount of 0.5–4 times that of the charge-generating substance, are dissolved or dispersed in a solvent by a dispersing means such as homogenizer, ultrasonic apparatus, ball mill, vibrating ball mill, sand mill, attritor or roll mill, and the resultant coating liquid may be applied onto a substrate and then dried. The charge generation layer may preferably have a thickness of about 0.1–1 μm, more preferably 0.1–0.8 μm.

In order to form the charge transport layer, the above-mentioned charge-transporting substance and a binder resin are dissolved or dispersed in a solvent, and the resultant coating liquid may be applied onto the charge generation layer. The mixing ratio of the charge-transporting material to the binder resin may preferably be about 2:1 to 1:2. Further, examples of the solvent may include: ketones such as acetone and methyl ethyl ketone; esters such as methyl acetate and ethyl acetate; chlorohydrocarbons such as chlorobenzene, chloroform, and carbon tetrachloride; etc.

In order to apply the above-mentioned coating liquid, there may be used various coating methods such as dip coating, spray coating, spinner coating. The drying may be conducted for a time in the range of 5 minutes to 5 hours preferably 10 minutes to 2 hours, at a temperature of 10° C. to 200° C., preferably 20° C.–150° C. under quienscent condition or under blowing. The thus formed charge transport layer may preferably have a thickness of about 5–30 μm, more preferably about 15–20 μm.

Examples of the binder resin used for the formation of the charge transport layer may include: acrylic resins, styrene resins, polyesters, polycarbonates, polyarylates, polysulfones, polyphenylene oxide resins, epoxy resins, polyurethane resins, alkyd resins, unsaturated resin, etc. Among these, preferred examples may be: polymethyl methacrylate, polystyrene, styrene-acrylonitrile copolymer, polycarbonate, or diallyl phthalate resin. Particularly preferred examples may be: polymethyl methacrylate, polystyrene, styrene-acrylonitrile copolymer, or diallyl phthalate resin.

Further, the charge transport layer and/or the charge generation layer used in the present invention may further contain various additives such as lubricant, antioxidant, and ultraviolet ray-absorbing agent.

The present invention will be explained more specifically with reference to examples. In the following description "parts" are parts by weight.

Example 1

First, the following Samples 1 to 3 were prepared as photosensitive members.

<Sample 1>

A 5% solution of a polyamide resin (trade name: Amilan CM-8000, mfd. by Toray K.K.) in methanol was applied onto a substrate of an aluminum cylinder having a diameter of 80 mm and a length of 360 mm by dip coating and then dried at 70° C. for 10 min. thereby to form a 1 μm-thick undercoat layer.

Next, 10 parts of a bisazo pigment represented by the following structural formula as a charge-generating substance, and 8 parts of a polyvinyl butyral resin (S-LEC BXL, mfd. by Sekisui Kagaku K.K.) as a binder resin were dispersed in 60 parts of cyclohexanone as a solvent by means of a sand mill using 1 mm-diameter glass beads, for 20 hours.

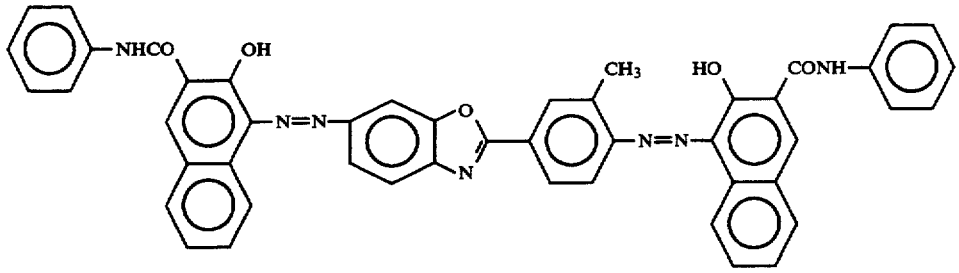

To the resultant dispersion, an appropriate amount (70–120 parts) of methyl ethyl ketone was added, and then the dispersion was applied onto the undercoat layer by dip coating and dried at 50° C. for 10 minutes thereby to form a 0.12 μm-thick charge generation layer.

Then, 7 parts of a hydra zone compound represented by the following structural formula as a charge-generating substance, and 10 parts of a styreneacrylonitrile copolymer (trade name: Sanrex SAN-C, mfd. by Mitsubishi-Monsanto Kasei K.K. ) as a binder resin were dissolved in 50 parts of monochlorobenzene.

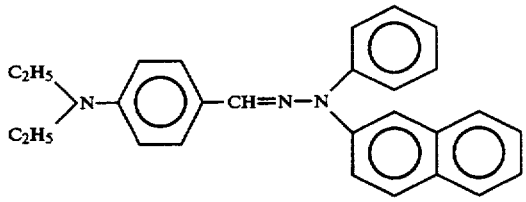

The resultant coating liquid was applied onto the above-mentioned charge generation layer to form a 19 μm-thick charge transport layer, whereby a photosensitive member (Sample 1) was prepared. The surface hardness of the thus prepared photosensitive member was 17 g.

<Sample 2>

A photosensitive member (Sample 2) was prepared in the same manner as in the preparation of Sample 1 except that a styrene-methyl methacrylate copolymer (trade name: Estyrene MS-300, mfd. by Shin-Nichitetsu Kagaku K.K.) was used as the binder resin for a charge transport layer, instead of the styrene-acrylonitrile copolymer used for Sample 1. The surface hardness of the thus prepared photosensitive member was 21 g.

<Sample 3>

A photosensitive member (Sample 3) was prepared in the same manner as in the preparation of Sample 1 except that a bisazo pigment represented by the following formula was used instead of the bisazo pigment used for the charge generation layer of Sample 1, and a polycarbonate resin having a weight-average molecular weight of 22,000 (polycarbonate Z represented by the following formula) was used instead of the styrene-acrylonitrile copolymer used for the charge transport layer of Sample 1. The surface harndness of the thus prepared photosensitive member was 22 g.

bisazo pigment

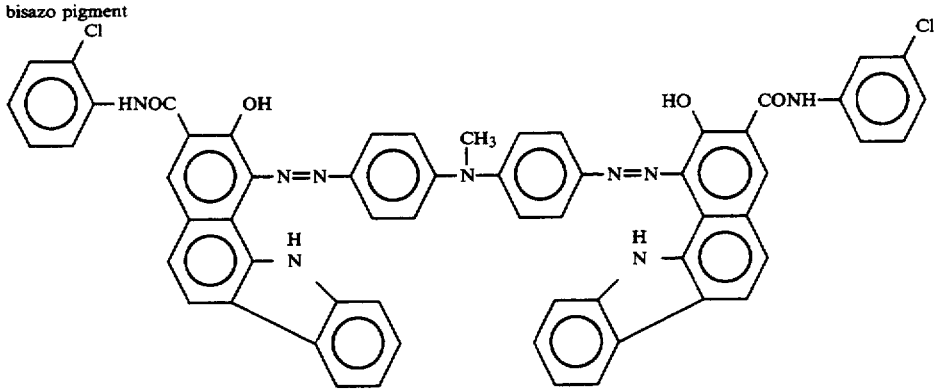

polycarbonate resin

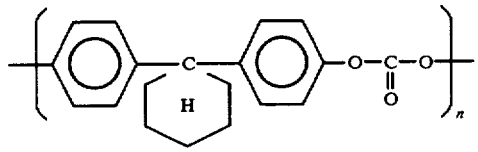

n: 75

Then, a charging device as shown in FIG. 2 was loaded into an electrophotographic apparatus as shown in FIG. 1. The fundamental system of the electrophotographic apparatus shown in FIG. 1 used herein was one obtained by modifying a commercially available copying machine (NP 3525, mfd. by Canon K.K.). More specifically, the image exposure device (not shown) for providing a light beam 3, the developing device 4, the pair of rollers 5*a* for supplying a transfer material, the guide 5*b*, the charges 6 and 7, the transfer material conveyor 8, and the pre-exposure light source 10 of the above copying machine were used as such. As the photosensitive member 1, the above-mentioned Samples 1 to 3 were used. The cleaner 9 was so modified that the cleaning was effected only by a blade cleaning method using a cleaner blade of a silicone rubber. The cleaner blade was so disposed as to contact the photosensitive member under the following conditions:

blade pressure: 20 g/cm
contact angle: 28°
depth of penetration: 1.5 mm

Incidentally, "depth of penetration" used herein was a hypothetical depth of penetration into which the tip of the blade could reach as measured from the surface of the photosensitive member if the flexible blade could have been disposed without flexure, i.e., without being obstructed by the surface of the photosensitive member.

Further, as the electroconductive member for direct charging, a charging roller (i.e., an electroconductive roller) 2 was used. The charging roller 2 was one obtained by disposing a hollow cylindrical member of a urethane rubber which has an outside diameter of 30 mm and a length of 340 mm and contained carbon dispersed therein, around a shaft of iron having a diameter of 5 mm and a length of 354 mm. The urethane rubber layer had a resistivity of $10^6$ Ω.cm and a rubber hardness of 40° measured by means of a rubber hardness meter (GS-706, mfd. by Teclock Co.) based on JIS-A Standard.

In this instance, a voltage obtained by superposing an AC voltage having a Vpp (peak-to-peak voltage) of 1500 V and a frequency of 1000 Hz on a DC voltage of 700 V, was applied to the charging roller 2. Further, the nip width between the charging roller 2 and the photosensitive member 1 was 1.0 mm and the load per unit area was 10 g/mm$^2$. Further, in this instance, four kinds of cleaner blades were used. Among these, as shown in FIG. 3, the lengths ($W_2$) of two shorter blades were 2 mm and 1 mm smaller than the direct charging width $W_4$ ( i. e., 340 mm) respectively. On the other hand, the lengths ($W_2$) of two longer blades were 1 mm and 2 mm larger than the direct charging width $W_4$, respectively. These four kinds of cleaner blades 9a were respectively caused to contact the photosensitive member 1 so that the distances from both ends of the cleaner blade 9a to the corresponding ends of the direct charging width ($W_4$) were equal to each other, as shown in FIG. 3.

As described above, four kinds of the relationships between the charging width ($W_4$) and the cleaning width ($W_2$) were provided, as shown in FIG. 3. Four kinds of conditions respectively corresponding to the above four kinds of relationships were provided as follows:

Condition I: $\left(\frac{W_2 - W_4}{2}\right) = -1.0$ mm

Condition II: $\left(\frac{W_2 - W_4}{2}\right) = -0.5$ mm

Condition III: $\left(\frac{W_2 - W_4}{2}\right) = +0.5$ mm

Condition IV: $\left(\frac{W_2 - W_4}{2}\right) = +1.0$ mm

Under these Conditions I–IV, a successive copying test of 10,000 sheets was conducted by using the above-mentioned photosensitive members of Samples 1–3. This successive copying test was conducted under 35° C. and 90% RH conditions by using A4-size sheets of paper and an original image having an image proportion (i.e., the proportion of the image portion to the total area) of 7%. In this test, the evaluation items, were image blur, decrease in the image density of a solid black image, the number of dielectric breakdown on the photosensitive member, and unevenness in image density based on ununiform charging.

Image Blur

The copied image obtained at the time of 10,000 sheets of copying (hereinafter referred to as "final copied image") was observed with the naked eye in comparison with that obtained at the initial stage (hereinafter, referred to as "initial copied image"). A case wherein the final copied image was clear, i.e., substantially the same as the initial copied image was represented by a symbol "○". A case wherein the final copied image was clearly blurred was represented by a symbol "×". A case intermediate between the above-mentioned two cases was represented by a symbol "Δ".

[Decrease in Image Density]

The solid black image portion of the final copied image was measured by means of a Macbeth densitometer. The thus obtained image densities were represented, by the following symbols:

○: 1.0 or more
Δ: not less than 0.7 and less than 1.0
×: not less than 0.5 and less than 0.7
××: less than 0.5

[Number of Dielectric Breakdown]

The number of black streaks (appearing in the longitudinal direction perpendicular to the rotating direction of the photosensitive member) and black spots was counted by the naked eye with respect to a portion of the final copied image corresponding to one rotation of the photosensitive member drum.

[Image Density Unevenness]normal image density ($d_{max}-d_{min}$) and the minimum image The difference ($d_{max}$−drain) between the density ($d_{min}$) was determined by means of a Macbeth densitometer with respect to the solid black image portion of the final copied image corresponding to the original solid black image portion. Herein, the normal image density ($d_{max}$) was the image density in a portion which showed a maximum image density. Further, the minimum image density ($d_{min}$) was the image density in a portion which corresponded to a portion of the photosensitive member surface supplied with insufficient charges and showed a minimum image density.

The thus obtained image density differences ($d_{max}-d_{min}$) were represented by the following symbols:

• : 0.2 or less
○: more than 0.2 and not more than 0.3
Δ: more than 0.3 and not more than 0.4
×: more than 0.4

The thus obtained results were shown in the following Table 1.

TABLE 1

| | | Image blur | Decrease in solid image density | Number of dielectric breakdown | Unevenness in image density |
|---|---|---|---|---|---|
| Sample 1 | | | | | |
| Condition | I | ○ | ○ | 6 | ◎ |
| | II | ○ | ○ | 4 | ◎ |
| | III | ○ | ○ | 0 | ◎ |
| | IV | ○ | ○ | 0 | ◎ |
| Sample 2 | | | | | |
| Condition | I | ○ | ○ | 5 | ◎ |
| | II | ○ | ○ | 3 | ◎ |
| | III | ○ | ○ | 0 | ◎ |
| | IV | ○ | ○ | 0 | ◎ |
| Sample 3 | | | | | |
| Condition | I | ○ | ○ | 1 | ◎ |
| | II | ○ | ○ | 2 | ◎ |
| | III | ○ | ○ | 0 | ◎ |
| | IV | ○ | ○ | 0 | ◎ |

As shown in the above Table 1, under Conditions I and II wherein the direct charging width ($W_4$) was larger than the cleaning width ($W_2$), dielectric breakdowns were caused with respect to all the Samples. On the other hand, under Conditions III and IV wherein the cleaning width ($W_2$) entirely covered the direct charging width ($W_4$), the above-mentioned problem was not encountered at all, whereby copied images of extremely high quality were always provided.

Example 2

A photosensitive member (Sample 4) was prepared in the same manner as in the preparation of Sample 1 except that a polymethyl methacrylate (trade name: MB-3002, mfd. by Mitsubishi Rayon K.K.) was used as the binder resin for a charge transport layer, instead of the styrene-acrylonitrile copolymer used for Sample 1. The surface hardness of the thus prepared photosensitive member was 26 g.

By using the photosensitive member of Sample 4, a successive copying test was conducted in the same manner as in Example 1 except that the nip width between the charging roller and the photosensitive member was set to 2.3 mm, and the load per unit area was set to 27 g/mm$^2$. The thus obtained results are shown in the following Table 2.

TABLE 2

| | | Image blur | Decrease in solid image density | Number of dielectric breakdown | Unevenness in image density |
|---|---|---|---|---|---|
| Sample 4 | | | | | |
| Condition | I | ○ | ○ | 8 | ◎ |
| | II | ○ | ○ | 5 | ◎ |
| | III | ○ | ○ | 0 | ◎ |
| | IV | ○ | ○ | 0 | ◎ |

As shown in the above Table 2, under Conditions I and II wherein the direct charging width ($W_4$) was larger than the cleaning width ($W_2$), dielectric breakdowns were caused. On the other hand, under Conditions III and IV wherein the cleaning width ($W_2$) entirely covered the direct charging width ($W_4$), the above-mentioned problem was not encountered at all, whereby copied images of extremely high quality were always provided.

Example 3

A photosensitive member (Sample 5) was prepared in the same manner as in the preparation of Sample 1 except that a polystyrene resin (trade name: HF 77, mfd. by Mitsubishi-Monsanto K.K. ) was used as the binder resin for a charge transport layer, instead of the styrene-acrylonitrile copolymer used for Sample 1. The surface hardness of the thus prepared photosensitive member was 15 g.

By using the photosensitive member of Sample 5, a successive copying test was conducted in the same manner as in Example 1 except that the nip width between the charging roller and the photosensitive member was set to 0.6 mm, and the load per unit area was set to 2.1 g/mm$^2$. The thus obtained results are shown in the following Table 3.

TABLE 3

| | | Image blur | Decrease in solid image density | Number of dielectric breakdown | Unevenness in image density |
|---|---|---|---|---|---|
| Sample 5 | | | | | |
| Condition | I | ○ | ○ | 5 | ○ |
| | II | ○ | ○ | 3 | ○ |
| | III | ○ | ○ | 0 | ○ |
| | IV | ○ | ○ | 0 | ○ |

As shown in the above Table 3, under Conditions III and IV wherein the cleaning width ($W_2$) was larger than the direct charging width ($W_4$), dielectric breakdown was not caused at all, whereby copied images of high quality were provided.

Example 4

In the electrophotographic apparatus as shown in FIG. 1 used in Example 1, an electroconductive blade with a plate form which had a rubber hardness of 45° and a width of 3 mm and a length of 340 mm and contained carbon dispersed therein to have a resistivity of $10^8$ Ω.cm, was used instead of the electroconductive roller shown in FIG. 2. The electroconductive blade was so disposed that it contacted the photosensitive member in a forward direction with respect to the rotating direction of the photosensitive member. Further, in this instance, the cleaner 9 which has originally been loaded in the copying machine (NP 3525) was used instead of the cleaner used in Example 1. The nip width between the electroconductive blade and the photosensitive member 1 was set to 1.3 mm, and the load per unit area was set to 22 g/mm$^2$.

By using the electrophotographic apparatus obtained above, a successive copying tests were conducted in the same manner as in Example 1, with respect to the photosensitive members of Samples 1 to 3 prepared in Example 1. The thus obtained results are shown in the following Table 4.

TABLE 4

| | | Image blur | Decrease in solid image density | Number of dielectric breakdown | Unevenness in image density |
|---|---|---|---|---|---|
| Sample 1 | | | | | |
| Condition | I | ○ | ○ | 18 | ◎ |
| | II | ○ | ○ | 6 | ◎ |
| | III | ○ | ○ | 0 | ◎ |
| | IV | ○ | ○ | 0 | ◎ |
| Sample 2 | | | | | |
| Condition | I | ○ | ○ | 23 | ◎ |
| | II | ○ | ○ | 12 | ◎ |
| | III | ○ | ○ | 0 | ◎ |
| | IV | ○ | ○ | 0 | ◎ |
| Sample 3 | | | | | |
| Condition | I | ○ | ○ | 5 | ◎ |
| | II | ○ | ○ | 3 | ◎ |
| | III | ○ | ○ | 0 | ◎ |
| | IV | ○ | ○ | 0 | ◎ |

As shown in the above Table 4, under Conditions I and II wherein the direct charging width ($W_4$) was larger than the cleaning width ($W_2$), dielectric breakdowns were caused with respect to all the Samples. On the other hand, under Conditions III and IV wherein the cleaning width ($W_2$) entirely covered the direct charging width ($W_4$), the above-mentioned problem was not encountered at all.

Example 5

Figure 4:
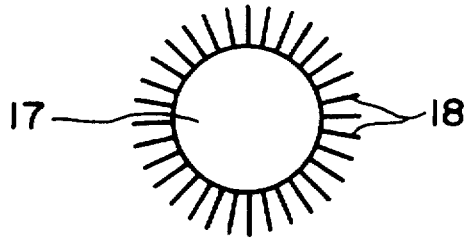
FIG. 4 is a schematic sectional view showing another embodiment of the electroconductive member.

Referring to the schematic sectional view of FIG. 4, there was provided a brush which comprised an iron shaft 17 and artificial electroconductive fibers 18 densely disposed on the surface of the iron shaft 17. The iron shaft 17 had a diameter of 20 mm, and the artificial fibers 18 had been formed by dispersing carbon in nylon-66 to have a resistivity of $10^{10}$ Ω.cm, and had a length of 5 mm. The thus obtained brush was loaded in the electrophotographic apparatus as shown in FIG. 1, instead of the electroconductive roller 2 shown in FIG. 2.

In this instance, the nip width was set to 1.2 mm, and the load per unit area was set to 5.8 g/mm$^2$.

By using the electrophotographic apparatus obtained above, successive copying tests were conducted in the same manner as in Example 1, with respect to the photosensitive members of Samples 1 to 3 prepared in Example 1. The thus obtained results are shown in the following Table 5.

TABLE 5

| | | Image blur | Decrease in solid image density | Number of dielectric breakdown | Unevenness in image density |
|---|---|---|---|---|---|
| Sample 1 | | | | | |
| Condition | I | ○ | ○ | 18 | ◎ |
| | II | ○ | ○ | 6 | ◎ |
| | III | ○ | ○ | 0 | ◎ |
| | IV | ○ | ○ | 0 | ◎ |
| Sample 2 | | | | | |
| Condition | I | ○ | ○ | 23 | ◎ |
| | II | ○ | ○ | 12 | ◎ |
| | III | ○ | ○ | 0 | ◎ |
| | IV | ○ | ○ | 0 | ◎ |
| Sample 3 | | | | | |
| Condition | I | ○ | ○ | 5 | ◎ |
| | II | ○ | ○ | 3 | ◎ |
| | III | ○ | ○ | 0 | ◎ |
| | IV | ○ | ○ | 0 | ◎ |

As shown in the above Table 5, under Conditions I and II wherein the direct charging width ($W_4$) was larger than the cleaning width ($W_2$), dielectric breakdowns were caused with respect to all the Samples. On the other hand, under Conditions III and IV wherein the cleaning width ($W_2$) entirely covered the direct charging width ($W_4$), the above-mentioned problem was not encountered at all.

Comparative Example

In comparison with the results obtained in Example 1, the corona charger which had originally been loaded in the copying machine (NP-3525) was used as such, instead of the charging roller 2 as shown in FIG. 1. The above-mentioned corona charger was disposed in the same position as that of the charging roller 2.

By using the thus obtained electrophotographic apparatus, a successive copying test was conducted in the same manner as in Example 1. The thus obtained results are shown in the following Table 6.

TABLE 6

| | | Image blur | Decrease in solid image density | Number of dielectric breakdown | Unevenness in image density |
|---|---|---|---|---|---|
| Sample 1 | | | | | |
| Condition | I | Δ | x | 0 | ◎ |
| | II | Δ | x | 0 | ◎ |
| | III | Δ | x | 0 | ◎ |
| | IV | Δ | x | 0 | ◎ |
| Sample 2 | | | | | |
| Condition | I | x | x | 0 | ◎ |
| | II | x | x | 0 | ◎ |
| | III | x | x | 0 | ◎ |
| | IV | x | x | 0 | ◎ |
| Sample 3 | | | | | |
| Condition | I | Δ | xx | 0 | ◎ |
| | II | Δ | xx | 0 | ◎ |
| | III | Δ | xx | 0 | ◎ |
| | IV | Δ | xx | 0 | ◎ |

As shown in the above Table 6, when ordinary corona charger was used, unevenness in image density was not caused with respect to all the Samples and all the Conditions. However, the image blur and the decrease in solid image density due to corona discharge products were caused in all cases.

In comparison with the results obtained in Example 1, it is clearly proved that the direct charging method is advantageous to a photosensitive member.

What is claimed is:

1. An image forming apparatus comprising:

a photosensitive member having a laminated photosensitive layer including a charge generation layer and a charge transport layer, said charge generation layer comprising a binder resin and an organic photoconductive material dispersed in said binder resin;

charging means, including an electroconductive member a portion of which is in direct contact with a surface of said photosensitive member, for charging said photosensitive member surface;

image exposure means for exposing said photosensitive member surface to form a latent image;

developing means for developing the latent image with a toner to form a transferable toner image on said photosensitive member surface;

transfer means for transferring the toner image to a transfer material; and cleaning means for removing contaminants, including residual toner, from said photosensitive member surface;

said charging means, image exposure means, developing means, transfer means, and cleaning means being disposed in the named order along a moving direction of said photosensitive member;

wherein with respect to a longitudinal direction of said photosensitive member, a width of said photosensitive member surface being cleaned by said cleaning means is larger than a width of the portion of said photosensitive member surface in direct contact with said electroconductive member; and wherein the width of the portion of said photosensitive member surface in direct contact with said electroconductive member is larger than the width of an imaging region of said photosensitive member surface, so that said cleaning means is effective to remove contaminants, including residual toner, remaining on the full width of the portion of said photosensitive member surface in direct contact with said electroconductive member, including a marginal region in excess of the imaging region, thereby reducing the possibility of a dielectric breakdown of said photosensitive member at the portion of the photosensitive member surface in direct contact with said electroconductive member; and wherein a nip width between said electroconductive member and said photosensitive member is at least 0.5 mm and a load applied therebetween per unit contact area is in a range between 0.5–30 g/mm$^2$.

2. An apparatus according to claim 1, wherein said surface of said photosensitive member has a scratch hardness of 15 g or larger.

3. An apparatus according to claim 1, wherein said electroconductive member is a member selected from the group consisting of a roller, a blade and a brush.

4. An image forming apparatus, comprising:

a photosensitive member having a laminated photosensitive layer including a charge generation layer and a charge transport layer, said charge generation layer comprising a binder resin and an organic photoconductive material dispersed in said binder resin;

charging means, including a charging member a portion of which is in direct contact with a surface of said photosensitive member, for charging said photosensitive member surface;

developing means for developing a latent image formed by exposing said photosensitive member after charging said photosensitive member surface, with a toner to form a transferable toner image on said photosensitive member surface;

cleaning means for removing contaminants, including residual toner, from said photosensitive member surface after transferring the toner image to a transfer material;

said charging means, developing means, and cleaning means being disposed in the named order along a moving direction of said photosensitive member;

wherein with respect to a longitudinal direction of said photosensitive member, a width of said photosensitive member surface being cleaned by said cleaning means is larger than a width of the portion of said photosensitive member surface in direct contact with said charging member; and wherein the width of the portion of said photosensitive member surface in direct contact with said charging member is larger than the width of an imaging region of said photosensitive member surface, so that said cleaning means is effective to remove contaminants, including residual toner, remaining on the full width of the portion of said photosensitive member surface in direct contact with said charging member, including a marginal region in excess of the imaging region; and wherein a nip width between said charging member and said photosensitive member is at least 0.5 mm and a load applied therebetween per unit contact area is in a range between 0.5–30 g/mm$^2$.

5. An image forming apparatus, comprising:

a photosensitive member having a laminated photosensitive layer including a charge generation layer and a charge transport layer, said charge generation layer comprising a binder resin and an organic photoconductive material dispersed in said binder resin;

charging means, including a charging member a portion of which is in direct contact with a surface of said photosensitive member, for charging said photosensitive member surface;

developing means for developing a latent image formed by exposing said photosensitive member after charging said photosensitive member surface, with a toner to form a transferable toner image on said photosensitive member surface;

cleaning means for removing contaminants, including residual toner, from said photosensitive member surface after transferring the toner image to a transfer material;

said charging means, developing means, and cleaning means being disposed in the named order along a moving direction of said photosensitive member;

wherein with respect to a longitudinal direction of said photosensitive member, a width of said photosensitive member surface being cleaned by said cleaning means is larger than a width of the portion of said photosensitive member surface in direct contact with said charging member; and wherein the width of the portion of said photosensitive member surface in direct contact with said charging member is larger than the width of an imaging region of said photosensitive member surface, so that said cleaning means is effective to remove contaminants, including residual toner, remaining on the full width of the portion of said photosensitive member surface in direct contact with said charging member including a marginal region in excess of the imaging region, thereby reducing the possibility of a dielectric breakdown of said photosensitive member at the portion of the photosensitive member surface in direct contact with said electroconductive member; and wherein a nip width between said charging member and said photosensitive member is at least 0.5 mm and a load applied therebetween per unit contact area is in a range between 0.5–30 g/mm$^2$.

* * * * *

UNITED STATES PATENT AND TRADEMARK OFFICE

CERTIFICATE OF CORRECTION

PATENT NO. : 5,430,527

DATED : July 4, 1995

INVENTOR(S) : AKIO MARUYAMA, et al.

It is certified that error appears in the above-indentified patent and that said Letters Patent is hereby corrected as shown below:

COLUMN 1

Line 39, "ozone, $NO_x$ is" should read --ozone and $NO_x$ are--.

COLUMN 3

Line 1, "they" should read --the--.

COLUMN 4

Line 24, "change" should read --charge--.

COLUMN 5

Line 68, "shown)" should read --shown),--.

COLUMN 7

Line 58, "a" should read --of a--.

COLUMN 8

Line 4, "scrached." should read --scratched,--.

COLUMN 11

Line 5, "hydra zone" should read --hydrazone--..
Line 7, "styreneacrylonitrile" should read --styrene-acrylonitrile--.

UNITED STATES PATENT AND TRADEMARK OFFICE

CERTIFICATE OF CORRECTION

PATENT NO. : 5,430,527 Page 2 of 4

DATED : July 4, 1995

INVENTOR(S) : AKIO MARUYAMA, et al.

It is certified that error appears in the above-indentified patent and that said Letters Patent is hereby corrected as shown below:

COLUMN 14

Line 22, "normal image density" should be deleted.
Line 23 should be deleted.
Line 24, "($d_{max}$-drain)" should read --($d_{max}$-$d_{min}$)--; and "the density" should read --the normal image density ($d_{max}$) and the minimum image density--.
Line 38, "•" should read --⊙--.
Line 50, "⊙" should read --⊙--.
Line 51, "⊙" should read --⊙--.
Line 52, "⊙" should read --⊙--.
Line 53, "⊙" should read --⊙--.
Line 54, "⊙" should read --⊙--.
Line 55, "⊙" should read --⊙--.
Line 56, "⊙" should read --⊙--.
Line 57, "⊙" should read --⊙--.
Line 58, "⊙" should read --⊙--.
Line 59, "⊙" should read --⊙--.
Line 60, "⊙" should read --⊙--.
Line 61, "⊙" should read --⊙--.

COLUMN 15

Line 26, "⊙" should read --⊙--.
Line 27, "⊙" should read --⊙--.
Line 28, "⊙" should read --⊙--.
Line 29, "⊙" should read --⊙--.
Line 62, "⊙" should read --⊙--.
Line 63, "⊙" should read --⊙--.
Line 64, "⊙" should read --⊙--.
Line 65, "⊙" should read --⊙--.

UNITED STATES PATENT AND TRADEMARK OFFICE

CERTIFICATE OF CORRECTION

PATENT NO. : 5,430,527

DATED : July 4, 1995

INVENTOR(S) : AKIO MARUYAMA, et al.

It is certified that error appears in the above-indentified patent and that said Letters Patent is hereby corrected as shown below:

COLUMN 16

Line 34, "⊙" should read --⊙--.
Line 35, "⊙" should read --⊙--.
Line 36, "⊙" should read --⊙--.
Line 37, "⊙" should read --⊙--.
Line 39, "⊙" should read --⊙--.
Line 40, "⊙" should read --⊙--.
Line 41, "⊙" should read --⊙--.
Line 42, "⊙" should read --⊙--.
Line 44, "⊙" should read --⊙--.
Line 45, "⊙" should read --⊙--.
Line 46, "⊙" should read --⊙--.
Line 47, "⊙" should read --⊙--.

COLUMN 17

Line 14, "⊙" should read --⊙--.
Line 15, "⊙" should read --⊙--.
Line 16, "⊙" should read --⊙--.
Line 17, "⊙" should read --⊙--.
Line 19, "⊙" should read --⊙--.
Line 20, "⊙" should read --⊙--.
Line 21, "⊙" should read --⊙--.
Line 23, "⊙" should read --⊙--.
Line 24, "⊙" should read --⊙--.
Line 25, "⊙" should read --⊙--.
Line 52, "⊙" should read --⊙--.
Line 53, "⊙" should read --⊙--.

UNITED STATES PATENT AND TRADEMARK OFFICE

CERTIFICATE OF CORRECTION

PATENT NO. : 5,430,527 Page 4 of 4

DATED : July 4, 1995

INVENTOR(S) : AKIO MARUYAMA, et al.

It is certified that error appears in the above-indentified patent and that said Letters Patent is hereby corrected as shown below:

COLUMN 17 (continued from page 3)

Line 54, "⊙" should read --⊙--.
Line 55, "⊙" should read --⊙--.
Line 57, "⊙" should read --⊙--.
Line 58, "⊙" should read --⊙--.
Line 59, "⊙" should read --⊙--.
Line 60, "⊙" should read --⊙--.
Line 62, "⊙" should read --⊙--.
Line 63, "⊙" should read --⊙--.
Line 64, "⊙" should read --⊙--.
Line 65, "⊙" should read --⊙--.

Signed and Sealed this

Seventh Day of May, 1996

*Attest:*

*Attesting Officer*

BRUCE LEHMAN

*Commissioner of Patents and Trademarks*